United States Patent [19]

Oxendine

[11] 4,057,914

[45] Nov. 15, 1977

[54] ORTHOPEDIC BOOTS

[76] Inventor: Ozmer Lee Oxendine, Box 083-A, Rte. 3, Maxton, N.C. 28364

[21] Appl. No.: 754,454

[22] Filed: Dec. 27, 1976

[51] Int. Cl.[2] ..... A43B 7/16

[52] U.S. Cl. ..... 36/81

[58] Field of Search ..... 36/81, 25 R, 32 R, 103, 36/83, 4

[56] References Cited

U.S. PATENT DOCUMENTS

| | | | |
|---|---|---|---|
| 2,505,773 | 5/1950 | Howe | 36/81 |
| 3,124,887 | 3/1964 | Vassar | 36/81 |
| 3,971,145 | 7/1976 | Stegerwald | 36/32 R |

*Primary Examiner*—Patrick D. Lawson
*Attorney, Agent, or Firm*—B. B. Olive

[57] ABSTRACT

A pair of boots for compensation of leg length deformities utilizes a pair of boots of similar outward appearance and whose sole portions appear thick similar to today's platform style. One boot remains unchanged internally and is worn by the shorter of the person's legs and the other boot is modified internally so that the sole area is formed around a shell and a hollow interior receives the wearer's longer leg. The difference in leg lengths determines the depth of the hollowed out area and the shell height.

5 Claims, 6 Drawing Figures

ORTHOPEDIC BOOTS

BACKGROUND OF THE INVENTION

1. Field of the Invention

This invention relates to boot construction and more specifically to boot construction for orthopedic purposes.

2. Description of the Prior Art

Heretofore, as far as applicant is aware, attempts at compensation of leg length deformities which dealt with shoe or boot construction has centered around building up the shoe interior or providing shoe inserts for building up the shorter leg.

U.S. Pat. No. 272,284 discloses a boot or shoe having an ordinary heel, sole and upper, enclosing therein a cork insert which provides elevation. This boot or shoe was intended for use by persons having deformed feet and limbs, or where one limb was shorter than the other.

Also, U.S. Pat. No. 2,505,773 discloses an orthopedic shoe which provides a "build-up" which comprises two sections of relatively thick cork which extends the length and width of the shoe and which compensates for the deformity of the wearer's leg.

As far as applicant is aware, all prior art has dealt with either adding to or building up the wearer's shoe or boot. The modern style platform boot design in particular has not been modified for use in orthopedic situations involving differences in leg length.

SUMMARY OF THE INVENTION

A pair of thick soled platform boots are designed to provide one boot of relatively conventional construction and a second boot whose thickened sole area is hollow so that the wearer's longer leg resides in the hollowed area. A shell within the hollow area provides the frame about which the invention boot is formed and secured thereto. The external appearance of both boots is substantially identical thereby hiding any external signs of a deformity. The difference in the wearer's leg lengths is the determining factor as to the height of the shell and the depth of the hollowed out area and the invention accommodates to a wide range of differences in leg length.

DESCRIPTION OF THE PREFERRED EMBODIMENT

Figure 1:
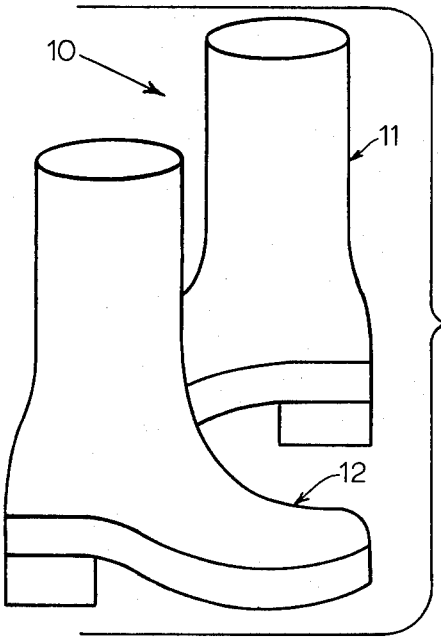
FIG. 1 is a perspective view of a pair of platform boots of the type utilized by the present invention to illustrate the identity of external appearance.

Referring now to the drawings and particularly to FIG. 1, there is illustrated a pair of boots 10 which externally appear to be similar in construction. Boots 10 are of modern platform style and have the thickened sole area appearance. Boot 11 remains unchanged internally and is worn by the shorter of the person's legs and boot 12 is modified internally so that the sole area is formed around shell 33 and is hollow on its interior and the wearer's longer leg fits down into the hollowed out area.

Figure 4:
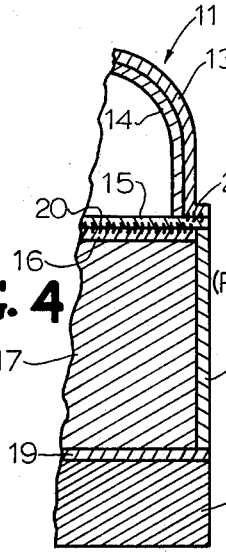
FIG. 4 (PRIOR ART)
FIG. 4 is a view similar to that of FIG. 3 but illustrating the prior art platform boot used by the shorter of the wearer's legs.
Figure 5:
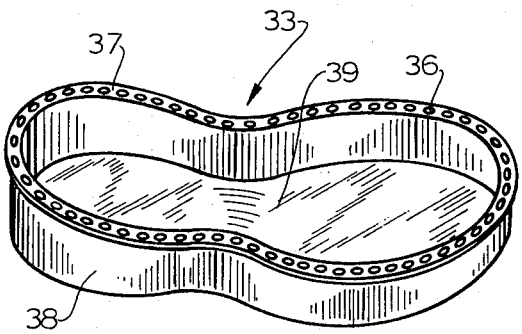
FIG. 5 is a perspective view of the shell employed by the present invention.

In order that a clear understanding of how boot 11 and modified boot 12 differ, the construction of both boots 11 and 12 will be described. The descripton will first be directed to boot 11 and its contruction as best seen in FIGS. 1 and 4. As seen in FIG. 1, boots 11 and 12 are identical in external appearance. FIG. 4 illustrates in fragmentary section the construction of boot 11. Boot 11 is made with an outer leather covering 13, inside liner 14, inner sole 15, first mid-sole 16, built-up cork area 17, leather covering 18, second mid-sole 19 and an outer sole 20. Outer leather covering 13 is stitched to inner sole 15 by stitches 21. This is done by turning out a small portion so that it lies flat upon the outer edge of inner sole 15. Inner sole 15 is in turn stitched to first mid-sole 16 by stitches 22. First mid-sole 16 is then glued to built-up cork 17. Cork 17 is then glued to second mid-sole 19 which is in turn glued to outer sole 20. A leather covering 18 is glued to first mid-sole 16 and cork 17 as shown in FIG. 4. This covering 18 gives a smooth desired appearance in construction and hides cork 17. The described construction provides a platform style boot which receives the shorter of the wearer's legs and hides any indication of a shorter limb.

Figure 2:
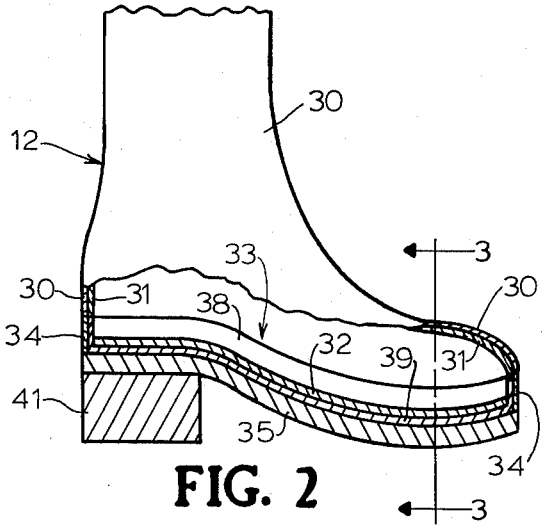
FIG. 2 is a side, elevation, fragmentary section view through the boot designed to receive the longer of the wearer's legs.
Figure 3:
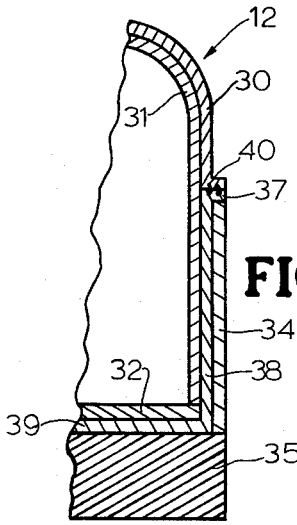
FIG. 3 is an enlarged, fragmentary, section view through the toe area of the boot of FIG. 2 substantially along line 3—3.

Shifting now to FIGS. 1, 2 and 3 which illustrate the construction of boot 12, boot 12 is constructed of an outer leather covering 30, inside liner 31, mid-sole 32, shell 33, leather covering 34 and outer sole 35. Outer leather covering 30 is stitched to shell 33 through appropriately provided holes 36 in outwardly turned rim 37 of shell 33. Shell 33 also has a vertical wall 38 and integral bottom portion 39. Once covering 30 is stitched with stitches 40 to shell rim 37, leather covering 34 is glued to the outer side of vertical wall 38. Mid-sole 32 is glued to the inside portion of shell 33 and outer sole 35 is in turn glued to the outer surface of the bottom 39 of shell 33. Also, leather covering 34 is glued to the exterior of wall 38 so that a smooth desired appearance in construction makes boots 11 and 12 appear identical externally.

It can be clearly seen from FIG. 3 that boot 12 does not have a cork area 17 as does boot 11. Boot 12 instead receives shell 33 which is hollow and which allows the wearer's longer leg to reside deeper into boot 12 than in boot 11. A suitable heel 41 is secured by conventional means to outer sole 35 when the remainder of boot 12 is assembled. The height of shell 33 is such that it will accommodate the difference in leg lengths so that the wearer may walk level since his longer leg resides deeper in boot 12 than does his shorter leg in boot 11. The difference in leg lengths would be the determining factor in how thick the sole is in the conventional boot and how thick it appears to be in the modified boot. Shell 33 has been shaped so that side 38 and bottom 39 conform to the shape of the wearer's foot thereby providing a comfortable and well-fitting boot and integral shell.

Shell 33 is preferably molded from plastic which provides the necessary strength to the boot sidewalls and can be made either with a solid base as illustrated or with thin, flexible strips which extend from one side to the other. Also, shell 33 could be stamped or fabricated from aluminum or other metal where weight is not a problem and added strength is desired. Shell 33, while being made into boot 12, can be removed from boot 12 and used to form a new boot when boot 12 is worn out or is desired to be replaced. In this way, shell 33 acts as a pattern for construction of the boot. As previously stated, the greater the difference in the length of the wearer's legs, the more of a "platform" appearance the boot must take.

Figure 6:
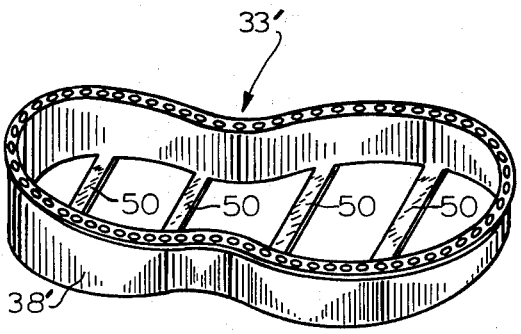
FIG. 6 illustrates an alternative shell construction.

FIG. 6 illustrates the alternate construction of shell 33' which has been previously referred to as having thin flexible strips 50. Strips 50 replace solid bottom 39 of shell 33. Strips 50 are form integrally with sidewall 38'. The alternative construction of shell 33' provides a shell which would allow more bending or flexing of the boot sole. Such a thin strip construction would require more inner covering (not shown) so that the strips are not uncomfortable to the wearer's foot.

In summary, it can be seen that the invention provides a much needed orthopedic aid for persons having differences in leg length. Also, such persons can now enjoy the stylish platform style boot or could enjoy other styles of boots or shoes having the necessary sole thickness required for the invention. The described "shell" or open top pan-like member, either with side and bottom walls or with a sidewall and bottom strip structure as in FIG. 6, especially affords a unique sole forming structure which can be readily molded to the particular needs of the user. It should be noted that the invention may be practiced without incorporating an integral shell member into the sole of the shoe for the longer leg, provided a hollowed-out portion conforming to the outline of the foot and having sufficiently strong sidewalls may be formed within the sole. Although the illustrated embodiment shows a pair of "boots", it should be pointed out that the invention may be utilized with lower shoes terminating below the ankles, and the term "shoe" refers to both boots and such lower shoes.

What is claimed is:

1. A pair of orthopedic shoes for compensation of leg length deformities of the wearer comprising:

a. a first shoe for use on the foot of the wearer's shorter leg, said first shoe having a relatively thick sole area providing built-up compensation means for the shortness of the wearer's shorter leg; and b. a second shoe for use on the foot of the wearer's longer leg, said second shoe presenting an outward appearance of having a relatively thick sole, the outer sole material of said second shoe being formed around a shell member to provide an outward appearance of a built-up sole, said shell member providing a recessed area within said second shoe for receiving the foot of the longer leg of the wearer;

whereby said first and second shoes provide a level walking condition for the wearer.

2. A pair of shoes as claimed in claim 1 wherein said shell member is made as an integral portion of said second shoe, said shell member being formed as an integral member having continuous sidewalls, bottom wall and an outwardly turned top flange extending around the periphery of said shell member, said top flange having holes therein for stitching the outer leather boot covering to said shell member.

3. A pair of shoes as claimed in claim 2 wherein said shell member is molded from plastic.

4. A pair of shoes as claimed in claim 2 wherein said shell member is fabricated from a metal material.

5. A pair of shoes as claimed in claim 2 wherein said shell member bottom wall comprises a series of thin, flexible strips.

* * * * *